US005533908A

United States Patent [19]

Henry et al.

[11] Patent Number: 5,533,908

[45] Date of Patent: Jul. 9, 1996

[54] LATCH AND MOUNTING MEMBER FOR A SURFACE MOUNTED ELECTRICAL CONNECTOR

[75] Inventors: Randall R. Henry, Harrisburg; William P. Moyer, Middletown; David A. Skotek, Harrisburg, all of Pa.

[73] Assignee: The Whitaker Corporation, Wilmington, Del.

[21] Appl. No.: 298,872

[22] Filed: Aug. 31, 1994

[51] Int. Cl.[6] ..... H01R 13/62

[52] U.S. Cl. ..... 439/329; 439/352; 439/353

[58] Field of Search ..... 439/329, 347, 439/350–353

[56] References Cited

U.S. PATENT DOCUMENTS

| | | | |
|---|---|---|---|
| 4,025,142 | 5/1977 | Huber et al. | 439/353 |
| 4,762,505 | 8/1988 | Asick et al. | 439/353 |
| 4,768,971 | 9/1988 | Simpson | 439/329 |
| 4,948,374 | 8/1990 | Carter | 439/329 |
| 5,021,002 | 6/1991 | Noschese | 439/352 |
| 5,096,436 | 3/1992 | Noschese | 439/352 |
| 5,120,256 | 6/1992 | Walden | 439/553 |
| 5,158,473 | 10/1992 | Takahashi et al. | 439/353 |
| 5,183,405 | 2/1993 | Elicker et al. | 439/108 |
| 5,197,901 | 3/1993 | Hashiguchi | 439/352 |
| 5,203,714 | 4/1993 | Tuan | 439/329 |
| 5,232,379 | 8/1993 | Lai | 439/570 |
| 5,334,049 | 8/1994 | Kachlic et al. | 439/552 |
| 5,383,794 | 1/1995 | Davis et al. | 439/352 |

*Primary Examiner*—P. Austin Bradley
*Assistant Examiner*—Jill DeMello

[57] ABSTRACT

An electrical connector (10) is disclosed having an improved securing member (16) that serves to accurately position the connector on a circuit board (14), to secure the connector thereto, and to latchingly engage a mating connector (12) to hold the two connectors in mated engagement. The securing member (16) includes a U-shaped portion (60) that straddles an outer wall (46) of the connector housing (20), one side (62) of the U-shaped portion extending through an opening (42) in the housing and through a hole (92) in the circuit board (14). The other side (64) of the U-shaped portion extends along the outside of the outer wall (46) and terminates in a mounting foot (70) that extends outwardly at right angles thereto. The mounting foot (70) is soldered to a metalized mounting pad (90) on the circuit board (14). Latch projections (78, 80) extend from the U-shaped portion (60) inwardly into an opening (30) in the connector housing (20) that receives the end (32) of the mating connector (12).

12 Claims, 5 Drawing Sheets

LATCH AND MOUNTING MEMBER FOR A SURFACE MOUNTED ELECTRICAL CONNECTOR

The present invention is related to surface mounted electrical connectors, and more particularly, to a securing member for accurately positioning the connector with respect to a circuit board and attaching the connector thereto and additionally, for latching the connector to a mating connector.

BACKGROUND OF THE INVENTION

Micro-miniature connectors are used in the telecommunications industry because of their very small size and light weight. Typically, the receptacle is surface mounted to a circuit board in a cellular telephone, pager, or other portable communications device that is carried by a person. The purpose of the micro-miniature connector is to easily interconnect certain components with circuitry on a circuit board and to provide a means for disconnecting them for maintenance or replacement. It is important that the two mating connectors be able to be releasably latched in mated engagement. However, equally important, one of the connectors must be accurately positioned on and secured to the circuit board. Well known devices for accomplishing these functions usually require substantial space because each function is served by a separate device. That is, separate devices are required for accurately positioning the connector with respect to the circuit board and for securing the connector thereto. Latching mechanisms that are incorporated into the housings of the two mating parts require a substantial amount of space, usually in the form of thicker housing walls that translate into a larger mounting foot print. This is an obvious disadvantage in the present application where the physical size of the connected must be minimized. Such micro-miniature connectors must, by necessity, be kept small.

What is needed is a micro-miniature connector adapted for surface mounting to a circuit board that has a relatively compact securing member for securing the connector to the circuit board and for holding the connector in mated engagement with its mating connector without increasing the amount of space required for mounting on a circuit board. Additionally, the securing member should provide accurate positioning of the connector with respect to the contact pads on the circuit board.

SUMMARY OF THE INVENTION

An electrical connector is provided having an insulating housing containing a plurality of contacts for mating with and electrically engaging other contacts of a mating electrical connector. The plurality of contacts have leads arranged to electrically engage contact pads on a surface of a circuit board. The connector housing has a first opening for receiving a portion of the mating connector during mating. A first side wall is provided along one side of the housing, and a second opening is formed through the housing adjacent the first side wall in communication with the first opening. A securing member is provided for attaching the connector to the surface of the circuit board and for engaging the mating connector during mating to hold the connector and the mating connector in mated engagement. The securing member includes a body having a first portion extending into the second opening, a mounting foot attached to the body arranged to be in mounted engagement with the surface of the circuit board, and a latch projection extending from the first portion into the first opening and arranged so that during mating the latch projection effects the holding engagement with the mating connector.

DESCRIPTION OF THE FIGURES

FIG. 6 is a cross-sectional view taken along the lines 6—6 in FIG. 2;

DESCRIPTION OF THE PREFERRED EMBODIMENT

Figure 1:
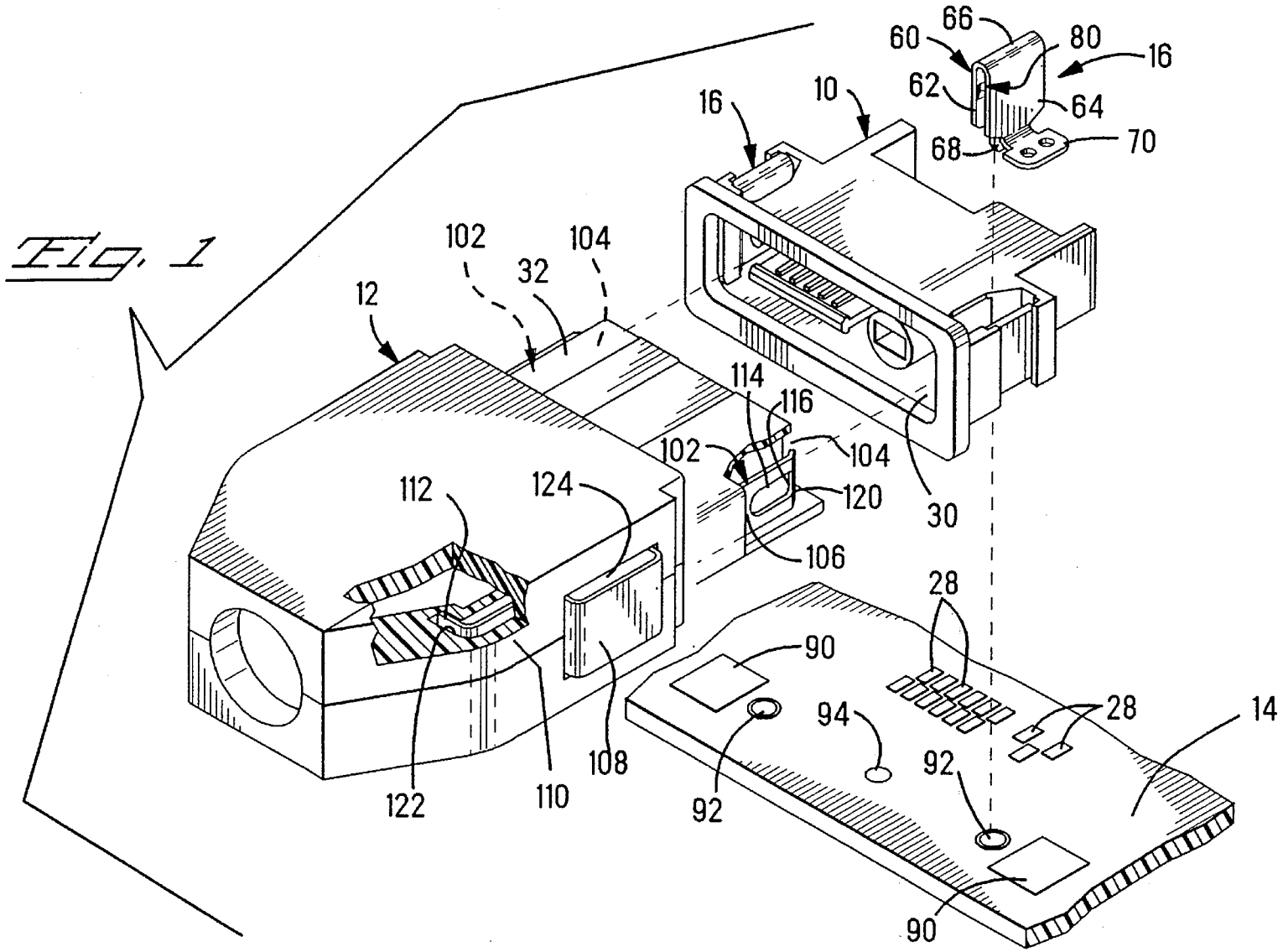
FIG. 1 is a partial exploded parts view of an electrical connector showing a receptacle connector and a mating plug connector, incorporating the teachings of the present invention.

There is shown in FIG. 1 a receptacle connector 10, a mating plug connector 12, and a typical circuit board 14 to which the receptacle connector is to be mounted. A pair of securing members 16 serve to accurately locate the receptacle connector with respect to contact pads on the circuit board, to secure the receptacle to the board, and to interact with the plug connector 12 to hold the plug in mating engagement with the receptacle.

Figure 4:
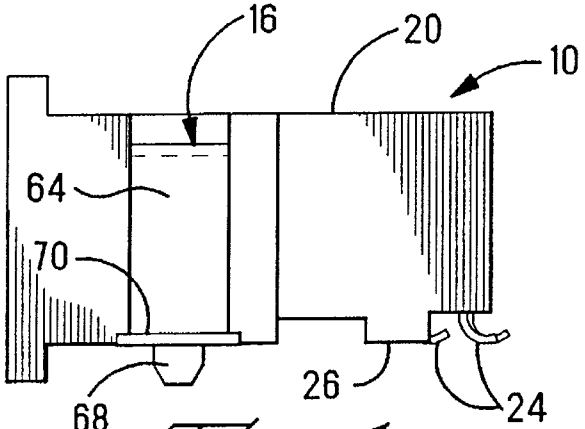
Figure 3:
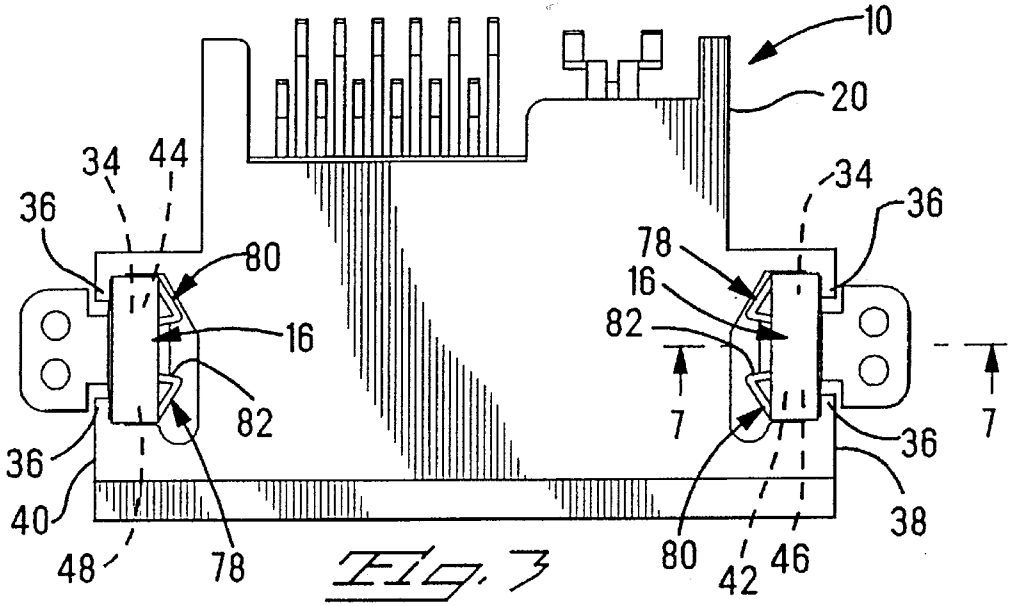
Figure 8:
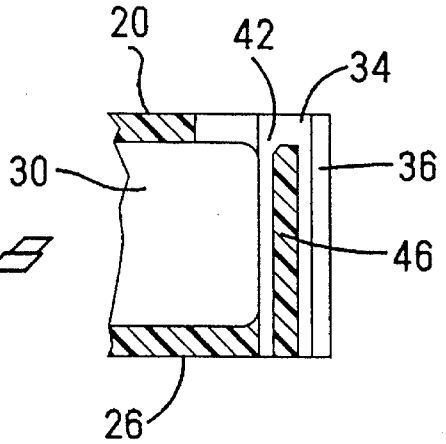
FIG. 8 is a view similar to that of FIG. 7 with the securing member removed.

As shown in FIGS. 2 through 5, the receptacle connector 10 includes an insulating housing 20 having a plurality of contacts 22 contained therein for mating with other contacts of the plug connector 12. Each of the contacts 22 has a lead 24 that is flush with or extends slightly below a mounting surface 26 of the housing 20, as best seen in FIG. 4, and is arranged to electrically engage one of several contact pads 28 that are arranged on a mounting surface of the circuit board 14. The contact pads 28 are interconnected with circuitry on the circuit board 14, in the usual manner. The housing 20 includes a first opening 30 for receiving the mating end 32 of the plug 12 when the plug contacts are mated with the contacts 22. A T-shaped slot 34 having two opposed flanges 36 is formed in opposite sides 38 and 40, as best seen in FIGS. 3 and 8. A pair of second openings 42 and 44 are formed through the housing adjacent each T-shaped slot 34 thereby forming side walls 46 and 48 respectively. The two second openings 42 and 44 extend completely through the housing 20 and intersect the mounting surface 26, as shown in FIG. 8. Additionally, each of the two second openings 42 and 44 are in communication with opposite ends of the first opening 30, that is, there is no wall separating the first opening and each of the second openings, as best seen in FIG. 8 with respect to the second opening 42.

Figure 13:
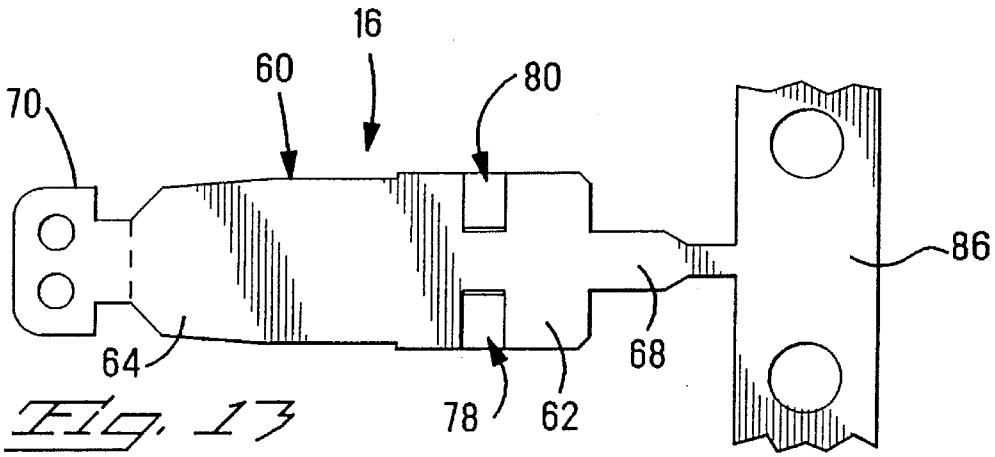
FIG. 13 is a partial flat pattern layout of the securing member of FIGS. 10, 11, and 12.
Figure 10:
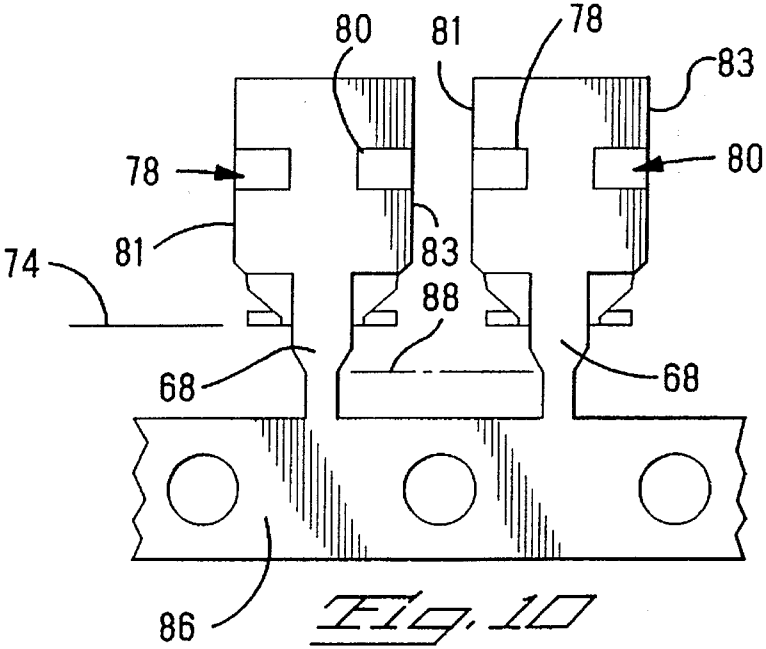
FIGS. 10, 11, and 12 are front, side, and top views of the securing member of FIG. 9, attached to a carrier strip.
Figure 12:
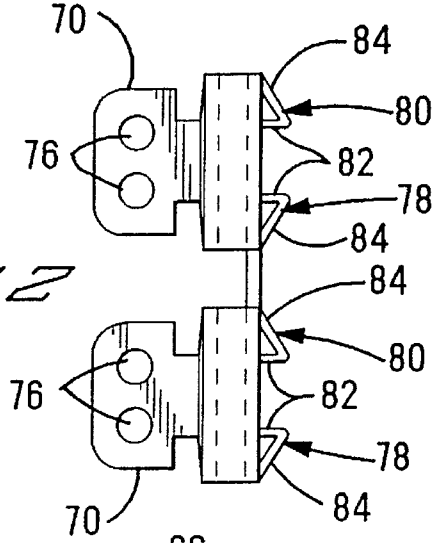
Figure 11:
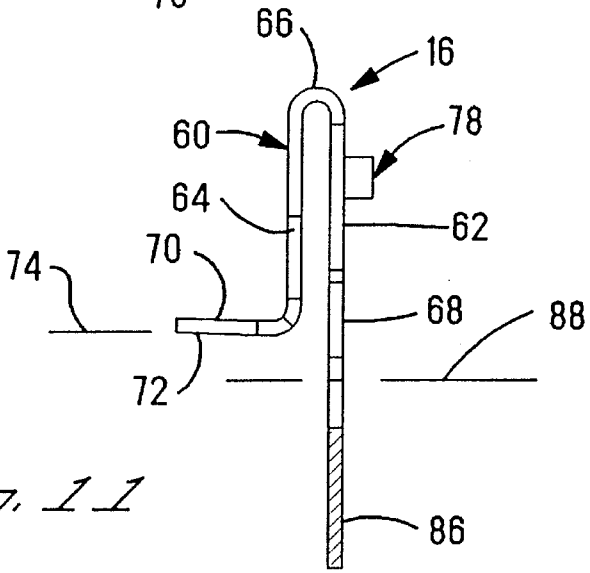

The securing member 16, as shown in FIGS. 9 through 12, includes a body 60 having a first portion 62 and a second portion 64 attached at a bend area 66 to form a U-shaped cross section. A shank 68 extends from the free end of the first portion and away from the bend area. A mounting foot 70 extends from an end of the second portion 64, opposite the bend area 66, at a right angle thereto, and includes a mounting surface 72. The two mounting surfaces 72 of the two securing members 16 define a plane 74 so that they both will engage the mounting surface of the circuit board 14 when the receptacle 10 is mounted thereto, as will be set forth below. The first and second portions 62 and 64 are substantially mutually parallel and perpendicular to the plane 74. A pair of holes 76 are formed through the foot 70 and arranged side by side for a purpose that will be explained below. A pair of latch projections 78 and 80 extend from the first portion 62 outwardly away from the second portion 64, as best seen in FIGS. 11 and 12. The two latch projections include opposing spaced apart latch surfaces 82 and opposite inclined surfaces 84. Each inclined surface 84 begins at a respective edge 81, 83 of the first portion 62 and, diverging from the first portion, terminates at its respective latch surface 82. The two latch surfaces 82 are near perpendicular to the first portion 62, as best seen in FIG. 12. The securing member 16 is stamped and formed in a stamping and forming machine from strip material in the usual manner, each member having its shank 68 attached to a carrier strip 86, as shown in FIGS. 10 through 12. Prior to utilizing the securing member 16 it is severed from the carrier strip 82 along the line 88 shown in FIGS. 10 and 11. A flat pattern of the securing member 16, with the latch projections 78 and 80 already formed, is shown in FIG. 13 for reference.

Figure 14:
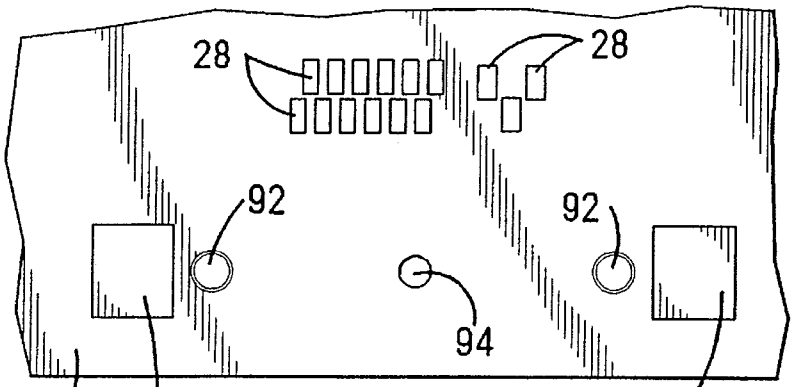
FIG. 14 is a plan view of a portion of a circuit board arranged for receiving the receptacle connector shown in FIG. 1.

As shown in FIG. 14, the circuit board 14, to which the receptacle connector 10 is to be mounted, includes the series of contact pads 28, two spaced mounting pads 90, two spaced holes 92 and a single hole 94. The contact pads 28 are metalized and interconnected with circuitry on the circuit board while the two mounting pads 90 are metalized and may or may not be interconnected with a ground circuit on the circuit board.

Figure 2:
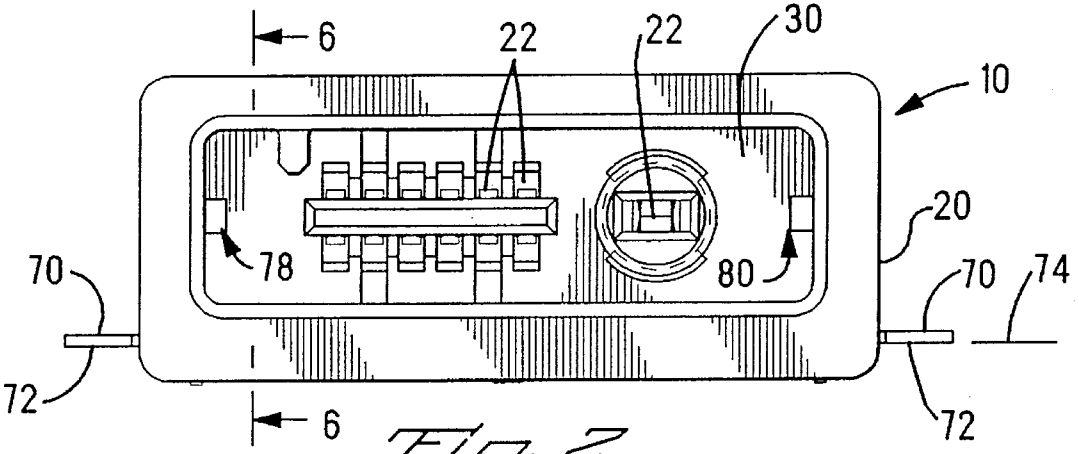
Figure 5:
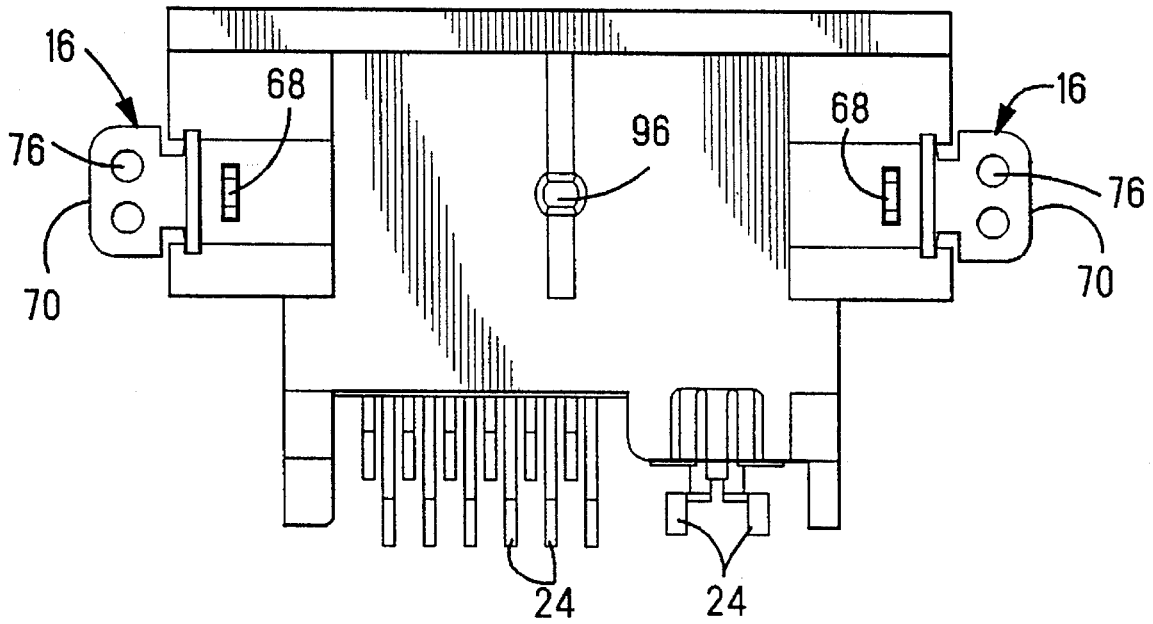
Figure 7:
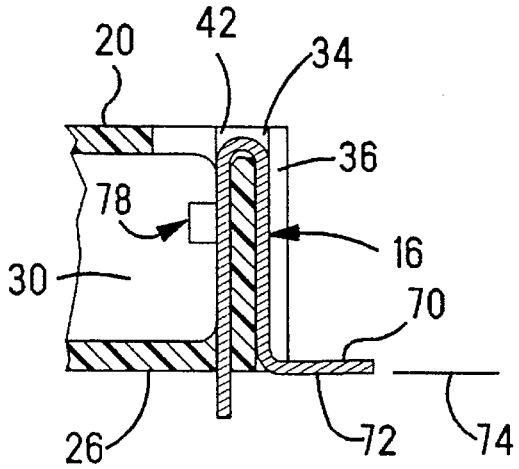
FIG. 7 is a cross-sectional view taken along the lines 7—7 in FIG. 3.

As shown in FIGS. 1 through 7, the securing members 16 are assembled to the receptacle connector 10 by inserting the first portion 62 of each into a respective second opening 42 and 44 of the housing 20 so that the side walls 46 and 48 are straddled by the first and second portions of their respective securing member. Note that the side walls 46 and 48 are between the bend areas 66 and the plane 74, as best seen in FIG. 7. The second portions 64 are in the T-shaped slots 34 and the mounting surfaces 72 of the two mounting feet 70 are coplanar with the plane 74. As best seen in FIGS. 2, 6, and 7, the two latch projections 78 and 80 of each securing member 16 extend into the first opening 30 so that they may engage the plug connector when it is mated to the receptacle and hold the two connectors in mated engagement.

Figure 5:
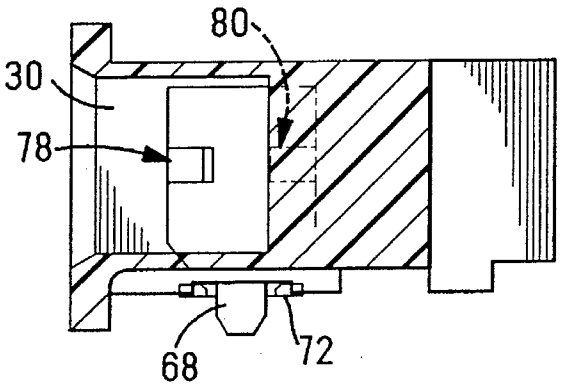
FIGS. 2, 3, 4, and 5 are front, top, side, and bottom views, respectively, of the receptacle connector shown in FIG. 1.

As best seen in FIG. 1 the receptacle connector 10 is positioned vertically above the circuit board 14 with the two shanks 68 in alignment with the two holes 92. The receptacle connector 10 is then lowered onto the circuit board 14 so that the two shanks 68 enter the holes 92 thereby accurately positioning the leads 24 with respect to their respective contact pads 28. A bifurcated lug 96 extending from the bottom of the housing 20, as best seen in FIG. 5, enters the hole 94 and frictionally engages the sides thereof to firmly hold the receptacle on the circuit board until the soldering operation is complete. Each of the two feet 70 of the two securing members 16 engages a respective mounting pad 90 on the circuit board while each of the leads 24 engages a respective contact pad 28. The assembly is then subjected to a suitable soldering operation for soldering the leads 24 and the feet 70 to their respective pads. This soldering operation may utilize any method that is well known in the industry. The holes 76 may be inspected after soldering to assure that solder filets are present and that the feet 70 are securely soldered to the mounting pads, thereby securing the receptacle connector 10 to the circuit board.

Figure 9:
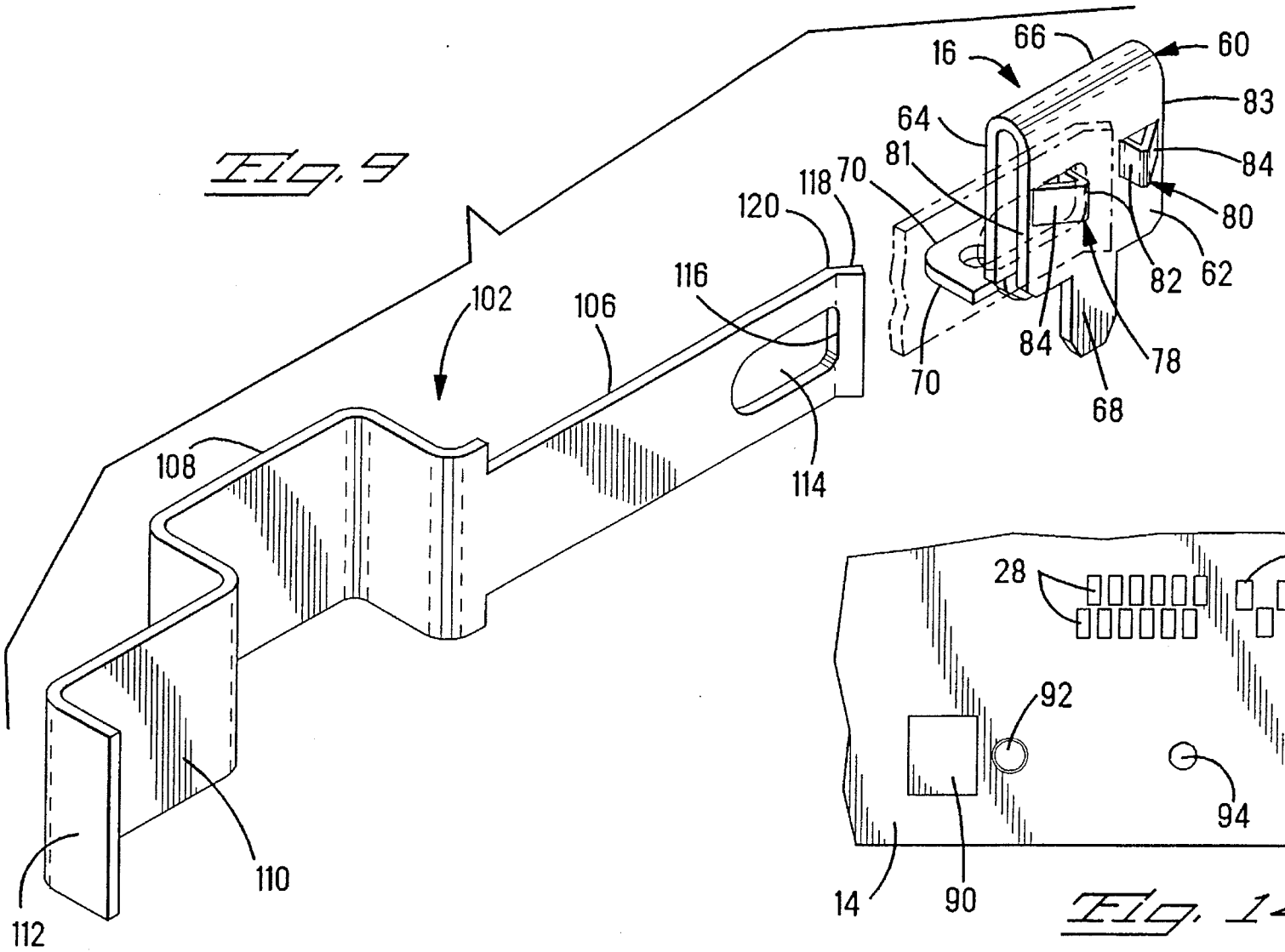
FIG. 9 is an isometric view of the securing member and associated plug latch shown in FIG. 1.

As shown in FIG. 1, the plug connector 12 includes a pair of latch members 102 in cavities 104 on opposite sides of the plug connector, one such latch member in each cavity. As will be explained, the latch members 102 are arranged to latchingly engage the latch projections 78 and 80 of the securing members 16 when the plug and receptacle connectors are mated. As best seen in FIG. 9, the latch member 102 includes an elongated arm 106 extending from a U-shaped section 108, a beam 110 extending from the U-shaped section opposite to the arm 106, and a shank 112 extending from the beam at right angles thereto. The arm 106 has an opening 114 formed therethrough adjacent its free end 118. The opening 114 formes a latch edge 116 adjacent the end 118 of the arm, as best seen in FIG. 9. The end 118 is bent in a direction opposite that of the U-shaped section to form a radiused or beveled portion 120. As best seen in FIG. 1, the shank 112 of the latch member 102 is securely held in a slot 122 formed within the housing of the plug connector 12. The U-shaped section 108 extends through an opening 124 in the side of the housing as shown. The housing includes clearance behind the beam, U-shaped section, and elongated arm so that the U-shaped section 108 may be depressed inwardly into the housing a small amount, thereby moving the end 118 and latch edge 116 inwardly by deflecting the beam 110. When the U-shaped section is released, the elasticity of the beam 110 will return the end and latch edge to their original positions. The two latch members 102 are arranged in mirror image on opposite sides of the plug connector so that the U-shaped sections extend outwardly from opposite sides of the connector housing in opposite directions. By simultaneously depressing both U-shaped sections inwardly, the corresponding two ends 118 and latch edges 116 deflect inwardly toward each other. When in their free state, the two latch edges 116 are substantially flush with the outer walls of the plug housing, while the two ends 118 extend inwardly a small amount due to the bevels 120. The mating end 32 of the plug connector 12 is sized to slip into the opening 30 of the receptacle connector with little side to side clearance.

When the plug connector 12 is mated with the receptacle connector 10, the end 32 is inserted into the opening 30 and the beveled portions 120 of the ends 118 engage and are deflected by the inclined surfaces 84 of the two latch projections 78 and 80 that extend into the opening 30 on opposite sides thereof. As insertion continues, the two ends 118 are deflected inwardly toward each other as the beveled portions 120 ride up the inclined surfaces 84. When the beveled portions 120 and latch edges 116 pass beyond the inclined surfaces, and the latch projections 78 and 80 are directly opposite their respective openings 114, the elasticity of the two beams 110 will return the ends 118 and latch edges 116 of the two latch members 102 to their original free state positions. With the latch members 102 in their free state positions the latch edges 116 are in latching engagement with the latch surfaces 82 of the two latch projections 78 and 80, thereby holding the plug and receptacle connector in mated engagement. Although only one of the latching projections 78 or 80 is utilized for each securing member 16, two oppositely formed latching projections are provided so that a single part can be used in either of the second openings 42 or 44.

While the securing member 16 is shown in conjunction with a receptacle connector 10, this is by way of example only and it will be understood that the teachings of the present invention may be advantageously applied to a plug connector or other suitable electrical interconnecting device as well.

An important advantage of the present invention is that the two securing members serve three purposes: (1) to accurately locate the connector with respect to the contact pads on the circuit board; (2) to secure the connector to the circuit board; and (3) to latchingly engage the mating connector to hold the two connectors in mated engagement. This results in fewer necessary parts and a simpler connector structure. Additionally, the identical securing member is used on both sides of the connector. This further reduces the number of required inventory parts and associated costs in the manufacturing of the connector.

We claim:

1. In an electrical connector having an insulating housing containing a plurality of contacts for mating with and electrically engaging other contacts of a mating electrical connector, said plurality of contacts having leads arranged to electrically engage contact pads on a surface of a circuit board, said housing having a first opening for receiving a portion of said mating connector during said mating, a first side wall along one side thereof, and a second opening through said housing adjacent said first side wall in communication with said first opening, a first securing member for attaching said connector to said surface of said circuit board and for engaging said mating connector during said mating to hold said connector and said mating connector in mated engagement, comprising:

(a) a body having a first portion extending into said second opening;

(b) a mounting foot attached to said body arranged to be in mounted engagement with said surface of said circuit board; and (c) a latch projection extending from said first portion into said first opening and arranged so that during said mating said latch projection effects said holding engagement with said mating connector.

2. The connector according to claim 1 wherein said body includes a second portion having an end attached to said first portion at a bend area and another end attached to said mounting foot, said first and second portions being substantially parallel and mutually opposed so that said first and second portions straddle said first side wall of said housing.

3. The connector according to claim 2 wherein a bottom surface of said mounting foot defines a plane that is coplanar with said surface of said circuit board and said first securing member is arranged so that said first side wall is between said bend area and said plane.

4. The connector according to claim 3 wherein, said first and second portions are substantially perpendicular to said plane.

5. The connector according to claim 4 wherein said first portion includes a shank extending from an end opposite said bend area through said plane and adapted to extend into an opening in said surface of said circuit board.

6. The connector according to claim 4 wherein said latch projection extends from said first portion away from both said first and second portions.

7. The connector according to claim 6 wherein said first portion has two opposite edges perpendicular to said plane and wherein said latch projection includes a latch surface extending from said first portion spaced from said two edges and an inclined camming surface extending from one of said edges outwardly therefrom and terminating at said latch surface.

8. In an electrical connector having an insulating housing containing a plurality of contacts for mating with and electrically engaging other contacts of a mating electrical connector, said plurality of contacts having leads arranged to electrically engage contact pads on a surface of a circuit board, said housing having a first opening for receiving a portion of said mating connector during said mating, a first side wall along one side thereof, and a second opening through said housing adjacent said first side wall in communication with said first opening, a second side wall along another side thereof, and a third opening through said housing adjacent said second side wall in communication with said first opening, first and second securing members for attaching said connector to said surface of said circuit board and for engaging said mating connector during said mating to hold said connector and said mating connector in mated engagement, each securing member comprising:

(a) a body having a first portion, said first portions of said first and second securing members extend into said second and third openings of said housing, respectively;

(b) a mounting foot attached to said body arranged to be in mounted engagement with said surface of said circuit board; and (c) a latch projection extending from said first portion into said first opening and arranged so that during said mating said latch projection effects said holding engagement with said mating connector.

9. The connector according to claim 8 wherein each said body of said first and second securing member includes a second portion having one end attached to said first portion at a bend area and another end attached to said mounting foot, said first and second portions being substantially parallel and mutually opposed so that said first and second portions of said first securing member straddle said first side wall of said housing and said first and second portions of said second securing member straddle said second side wall thereof.

10. The connector according to claim 8 wherein each said first portion includes a shank extending therefrom and adapted to extend into a hole in said circuit board for accurately positioning said connector with respect thereto.

11. The connector according to claim 9 wherein said latch projection of each said first and second securing member includes a pair of protrusions arranged side by side and extending from their respective said first portion away from their respective said first and second portions and wherein each said protrusion includes a latch surface and an inclined camming surface extending from an edge of said first portion outwardly therefrom and terminating at said latch surface so that said latch surfaces are mutually opposing and said inclined camming surfaces extend from opposite edges.

12. The connector according to claim 11 wherein said opposing latch surfaces are mutually nearly parallel and nearly perpendicular to said first portion.

* * * * *